US008147057B2

(12) United States Patent
Hatanaka et al.

(10) Patent No.: US 8,147,057 B2
(45) Date of Patent: Apr. 3, 2012

(54) RESISTANCE GENERATING DEVICE AND RECORDING APPARATUS

(75) Inventors: Yuji Hatanaka, Suwa (JP); Yuki Moriya, Suwa (JP); Namiki Takeshi, Suwa-gun (JP)

(73) Assignee: Seiko Epson Corporation, Tokyo (JP)

( * ) Notice: Subject to any disclaimer, the term of this patent is extended or adjusted under 35 U.S.C. 154(b) by 930 days.

(21) Appl. No.: 12/174,448

(22) Filed: Jul. 16, 2008

(65) Prior Publication Data

US 2009/0046120 A1 Feb. 19, 2009

(30) Foreign Application Priority Data

Jul. 18, 2007 (JP) ..... 2007-187585

(51) Int. Cl.
*B41J 29/38* (2006.01)
*B41J 2/01* (2006.01)
*B65H 23/00* (2006.01)

(52) U.S. Cl. ..... 347/104; 347/16; 242/416

(58) Field of Classification Search ..... None
See application file for complete search history.

(56) References Cited

U.S. PATENT DOCUMENTS 6,286,780 B1 * 9/2001 Yuyama et al. ..... 242/563
2004/0104295 A1 * 6/2004 Fujioka ..... 242/422.4

FOREIGN PATENT DOCUMENTS

JP 06-219002 8/1994
JP 2002-187658 7/2002
JP 2004-291395 10/2004

* cited by examiner

*Primary Examiner* — Matthew Luu
*Assistant Examiner* — Kendrick Liu
(74) *Attorney, Agent, or Firm* — Workman Nydegger

(57) ABSTRACT

There is provided a resistance generating device including a resistance generating unit disposed inside the rotation axis, the resistance generating unit having an inner ring and an outer ring, one of the inner ring and the outer ring being combined with the rotation axis and the other one of the inner ring and the outer ring being combined with the fixed part, the one being rotated with respect to the other one while generating a rotational resistance, and a switch part disposed inside a surface of the rotation axis.

8 Claims, 8 Drawing Sheets

RESISTANCE GENERATING DEVICE AND RECORDING APPARATUS

BACKGROUND

1. Technical Field

The present invention relates to a resistance generating device and a recording apparatus, and in particular, to a resistance generating device that generates a resistance with respect to rotation of a roll formed by winding a long recording medium, and a recording apparatus equipped with the same.

2. Related Art

There is an ink jet type recording apparatus that ejects liquid such as ink on a recording medium from a recording head equipped with a fine nozzle. In such a type of apparatus, the recording head is reciprocated in a predetermined main scanning direction, and on the other hand, the recording medium is moved in a transport direction perpendicular to the main scanning direction. The combination of the main scanning and the transportation allows adhering ink in any area of the recording medium.

In the recording apparatus having the structure, a reciprocal movement area in the main scanning direction is determined by the specification of the apparatus. Some of the apparatus has a main scanning width more than 1 m to allow recording a large sized image such as a poster. On the other hand, the length of the recording medium in the transport direction is not restricted by the specification of the apparatus. Accordingly, there is a recording apparatus that continuously forms an image by loading a roll formed by winding a long recording medium.

When the roll is loaded in the recording apparatus, an end of the wound recording medium is pulled out and is sequentially provided for image formation. Herein, when pulling out of the recording medium is stopped, there is a case that the roll is continued to be rotated by inertia and the recording medium is slacked. In such a case, when the recording medium is pulled out at the next time, a tensile force is unfavorably impulsively applied to the recording medium at the time when the slackness of the recording medium is eliminated.

Further, even when the recording medium is continuously pulled out, wrinkles and the like are difficult to occur when a moderate tensile force is applied to the recording medium. Consequently, there is a case that a resistance generating device is used in order to generate a tensile force to the recording medium when using a rolled recording medium.

In JP-A-06-219002, a roll support mechanism that utilizes an idling torque of a torque limiter as a rotational resistance of a roll paper is described. It is described that a back tension can be stably applied to the roll paper and idling of the roll paper can be prevented with the roll support mechanism.

Further, in JP-A-2002-187658 (hereinafter, referred to as Patent Document 1), a structure is described in which a friction flange that rotates in synchronization with a rolled medium is provided and a back tension is generated by biasing the friction flange with respect to a fixed member. Further in Patent Document 1, a structure for unlocking the back tension is also described. Herewith, the back tension can be generated as necessary.

Further, in JP-A-2004-291395, a structure is described in which a plurality of torque limiters and a roll paper holder axis are selectively combined. Herewith, an appropriate back tension can be generated in accordance with the types of the recording medium.

In this manner, when the rolled recording medium is used, a back tension can be applied to the recording medium that is pulled out from the roll by utilizing an idling torque of the torque limiter. Further, it is also know that a different back tension is generated in accordance with the types of the recording medium.

However, in the resistance generating device capable of switching the resistance to be generated, a switch mechanism or the like is formed outside the roll in the axis direction. Accordingly, when the resistance generating device having a switching function is used, it can not be avoided that the size of the recording apparatus or the like is increased in the width direction of the recording medium.

SUMMARY

According to a first aspect of the invention, there is provided a resistance generating device including a rotation axis that rotates with a roll formed by winding a long recording medium, a fixed part disposed outside the rotation axis in a longitudinal direction of the rotation axis, the fixed part allowing rotation of the rotation axis while being fixed to an outside, a resistance generating unit disposed inside the rotation axis, the resistance generating unit having an inner ring and an outer ring, one of the inner ring and the outer ring being combined with the rotation axis and the other one of the inner ring and the outer ring being combined with the fixed part, the one being rotated with respect to the other one while generating a rotational resistance, and a switch part disposed inside a surface of the rotation axis, the switch part switching a combined state and a non-combined state in accordance with an operation from outside, the one and the rotation axis being combined and the other one and the fixed part being combined in the combined state and any one of combing of the one and the rotation axis and combing of the other one and the fixed part being unlocked in the non-combined state. Herewith, an appropriate resistance can be generated in accordance with the application by switching the magnitude of the resistance to be generated without extending to the outside of the rotation axis. Further, since both of the resistance generating unit and the switch part are disposed inside of the surface of the rotation axis, the rotation axis can be smoothly attached to the roll.

Further, it is preferable that a rotational resistance generated in the resistance generating unit is operated as a tensile force with respect to the recording medium when the recording medium is pulled out from the roll in the resistance generating device according to the first aspect of the invention. Herewith, an appropriate tensile force can be applied to the recording medium pulled out from the roll. Accordingly, the recording medium can be pulled out while applying an appropriate tensile force in accordance with the property such as bending rigidity of the recording medium, and wrinkling or the like can be prevented. Further, it can be prevented that the roll is rotated by inertia to cause slackness of the recording medium when pulling out of the recording medium is stopped.

Further, it is preferable that the resistance generating unit generates a rotational resistance in a rotational direction of the one with respect to the other one and does not generate a rotational resistance in the other rotational direction in the resistance generating device according to the first aspect of the invention. Herewith, when the recording medium that is once taken out is rolled back to the roll, the roll can be easily rotated.

Furthermore, it is preferable that a sub resistance generating unit for steadily generating a rotational resistance with respect to a rotation of the rotation axis with respect to the fixed part regardless of a state of the switch part is included in the resistance generating device according to the first aspect of the invention. Furthermore, it is preferable that the switch part selectively combines a plurality of resistance generating parts each of which generates a rotational resistance having a different magnitude to each other in the resistance generating device according to the first aspect of the invention. Herewith, the resistance generating device capable of generating not less than two-step rotational resistances can be provided.

Further, according to a second aspect of the invention, there is provided a recording apparatus including a rotation axis that rotates with a roll formed by winding a long recording medium, a fixed part disposed outside the rotation axis in a longitudinal direction of the rotation axis, the fixed part being fixed to an outside and being rotated with respect to the rotation axis, a resistance generating unit disposed inside the rotation axis, the resistance generating unit having an inner ring and an outer ring, one of the inner ring and the outer ring being combined with the rotation axis and the other one of the inner ring and the outer ring being combined with the fixed part, the one being rotated with respect to the other one while generating a rotational resistance, a switch part disposed inside a surface of the rotation axis, the switch part switching a combined state and a non-combined state in accordance with an operation from outside, the one and the rotation axis being combined and the other one and the fixed part being combined in the combined state and any one of combing of the one and the rotation axis and combing of the other one and the fixed part being unlocked in the non-combined state, and a recording head for ejecting ink towered the recording medium pulled out from the roll. Herewith, the aforementioned effects can be obtained in the recording apparatus.

Note that the aforementioned summary of the invention does not list all necessary characteristics of the invention. Further, sub-combinations of these characteristic groups can also be the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described through an embodiment of the invention. However, the following embodiment does not limit the invention according to the scope of Claims. Further, not all the combinations of characteristics described in the embodiment are necessary for solving means of the invention.

First Embodiment

Figure 1:
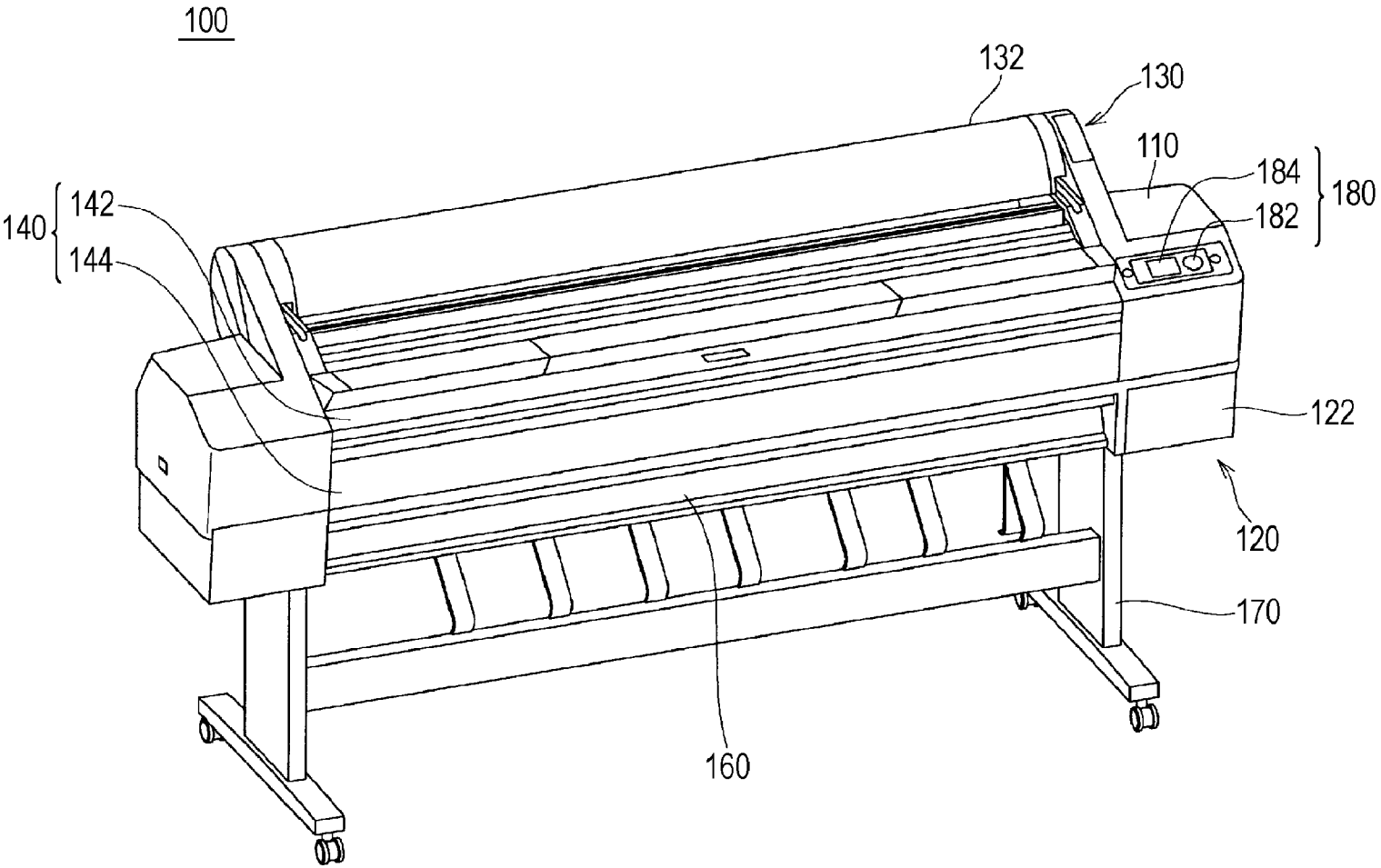
FIG. 1 is a perspective view showing an ink jet type recording apparatus according to an embodiment.

FIG. 1 is a perspective view showing an ink jet type recording apparatus 100 according to the embodiment. As shown in FIG. 1, the ink jet type recording apparatus 100 is equipped with a recording unit 140 whose longitudinal direction is horizontally disposed, a housing unit 110 that is attached to an end of the recording unit 140, a loading part 130 attached above the recording unit 140, and a leg part 170 that supports the recording unit 140 and the housing unit 110 from the lower direction.

A roll assembly 190 (see FIG. 3) around which a long recording medium 191 is wound is loaded in the loading part 130. In FIG. 1, the roll assembly 190 is covered with a roll cover 132. Further, an inner mechanism 200 (see FIG. 4) of the recording unit 140 is also covered with a top cover 142 and a front cover 144. A recording head 143 (see FIG. 4) described below is disposed in the recording unit 140, and ink is ejected towered the recording medium 191 fed to the recording unit 140 from the loading part 130.

The recording medium 191 is fed from the loading part 130 and an image is formed by the recording unit 140. Then, the recording medium 191 is discharged to a discharge part 160 that is formed below the recording unit 140. Note that the leg part 170 is attached in order to form a space for stacking the recording medium 191 that is discharged to the discharge part 160.

The housing unit 110 forms a space of a home position in which the recording head 143 that is evacuated from the recording unit 140 stays. The housing unit 110 is equipped with a cartridge holder 120 therebelow. In FIG. 1, an ink cartridge 124 (see FIG. 2) that is attached in the carriage holder 120 is covered with a holder cover 122. Further, an operation panel 180 is disposed on the upper surface of the housing unit 110. The operation panel 180 includes a display unit 184 that shows an operation state of the ink jet type recording apparatus 100 besides a switch 182 that is operated by a user.

Figure 2:
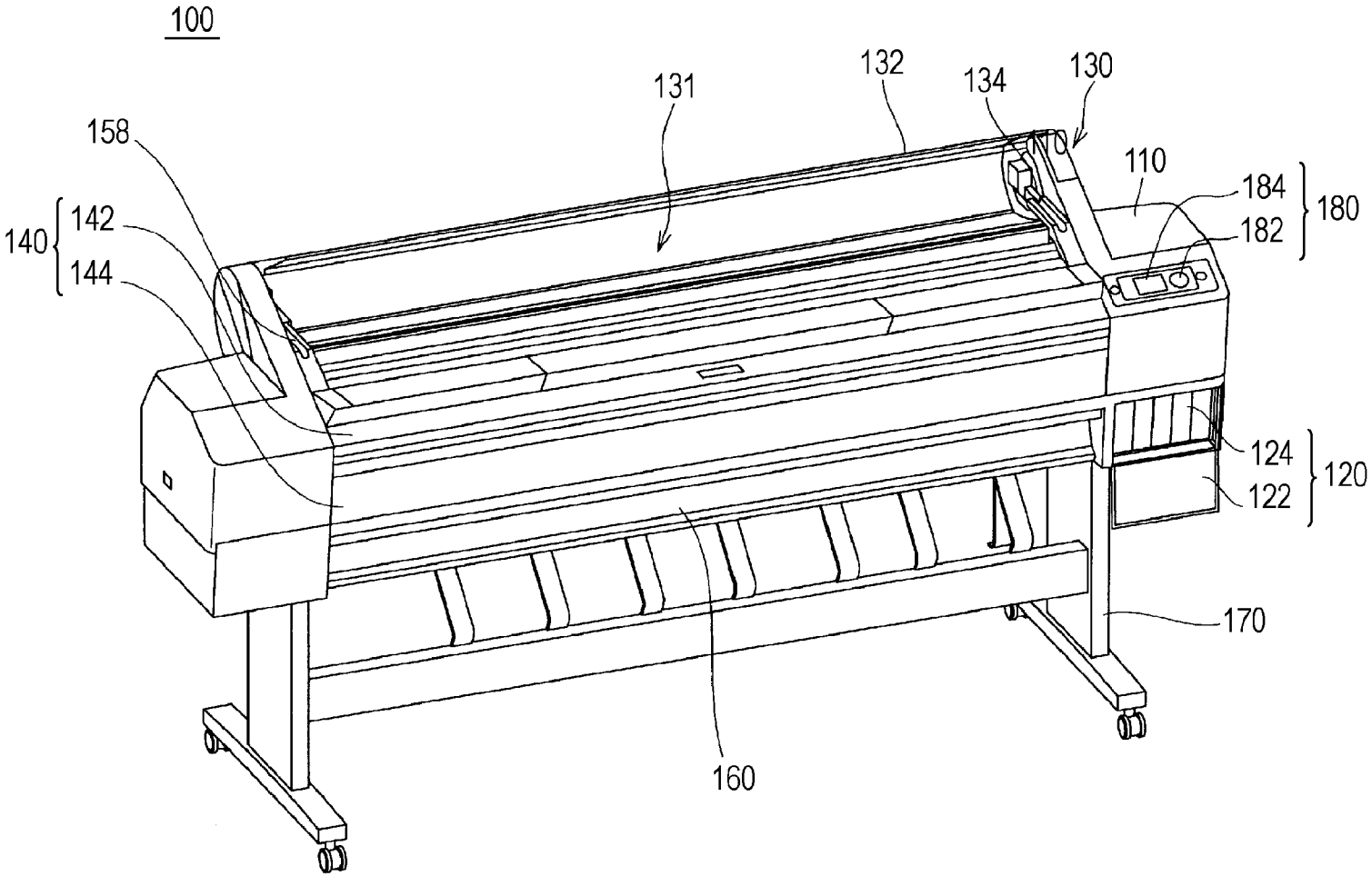
FIG. 2 is a diagram showing a state where a roll cover of a loading part is opened.

FIG. 2 is a diagram showing a state where the roll cover 132 of the loading part 130 is opened. As shown in FIG. 2, when the roll cover 132 is opened, an accommodation space 131 having an approximately cylindrical shape appears in the loading part 130. A roll assembly 190 described below (see FIG. 3) is loaded in the accommodation space 131.

Further, a pair of spindle support parts 134 are formed at the both inner side walls of the accommodation space 131. Each of the spindle support parts 134 has a concave up shape, and an end of a spindle member 194 of the roll assembly 190 and a fitting part 322 described below (see FIG. 3) are fitted therein.

Figure 3:
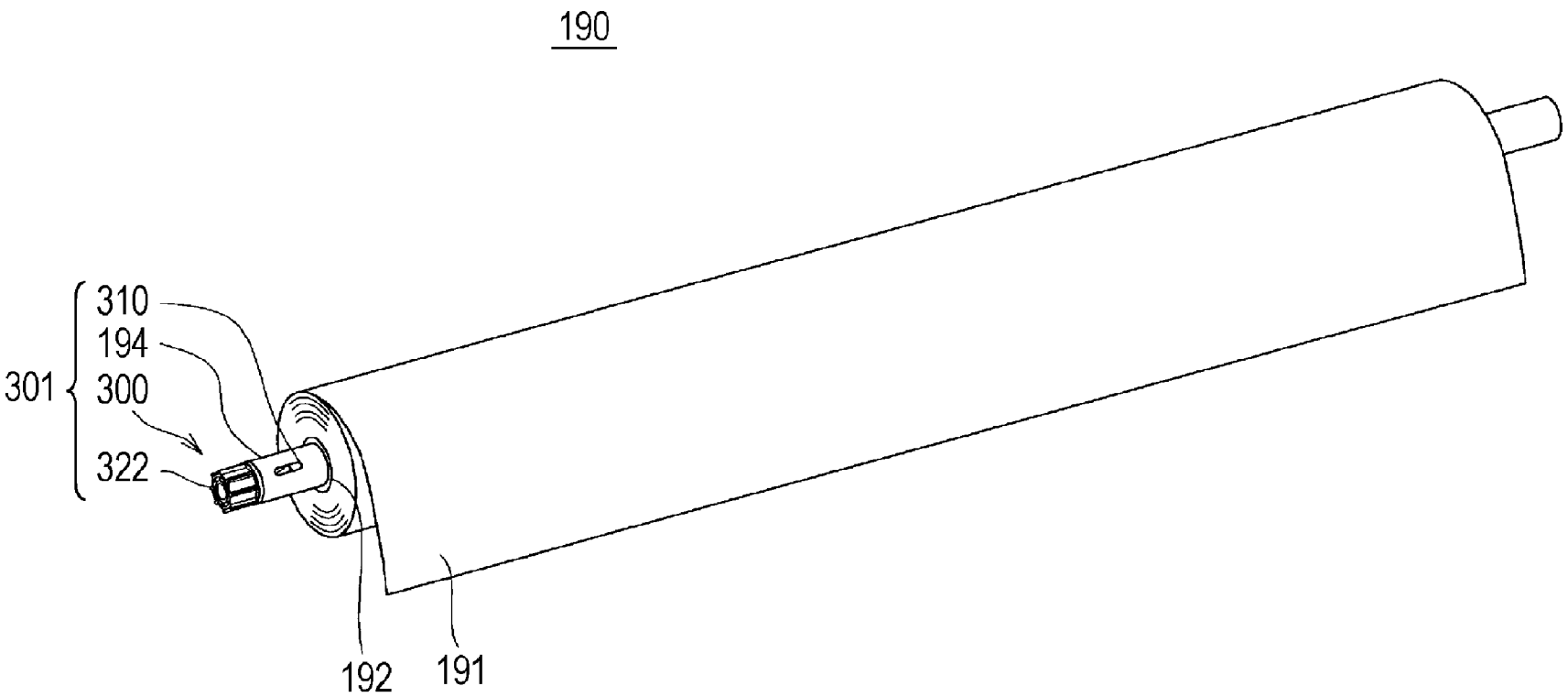
FIG. 3 is a perspective view showing an appearance of a roll assembly.

FIG. 3 is a perspective view showing an appearance of the roll assembly 190 that is loaded in the aforementioned loading part 130. As shown in FIG. 3, the roll assembly 190 includes a paper pipe 192 that becomes a core, the long recording medium 191 wound around the outer surface of the paper pipe 192, the spindle member 194 made of a metal that is inserted inside the paper pipe 192. The spindle member 194 is a hollow tube member, and a resistance generating unit 300 is attached at an end thereof (left end in FIG. 3) to form a spindle assembly 301. Note that, as the recording medium 191, a resin film, a textile product, or the like may be wound around besides a paper.

In the roll assembly 190, the spindle member 194 and the paper pipe 192 are combined to each other. Accordingly, when the recording medium 191 is pulled out from the roll assembly 190 loaded in the loading part 130, the spindle member 194 and the paper pipe 192 are integrally rotated.

Further, as described below, in the resistance generating unit 300 of the roll assembly 190, the fitting part 322 of the distal end is mutually fitted with the spindle support part 134 and fixed with respect to the side of the loading part 130. Accordingly, when the recording medium 191 is pulled out, the spindle member 194 and the paper pipe 192 are rotated whereas the fitting part 322 becomes a fixed part that does not rotate.

Figure 4:
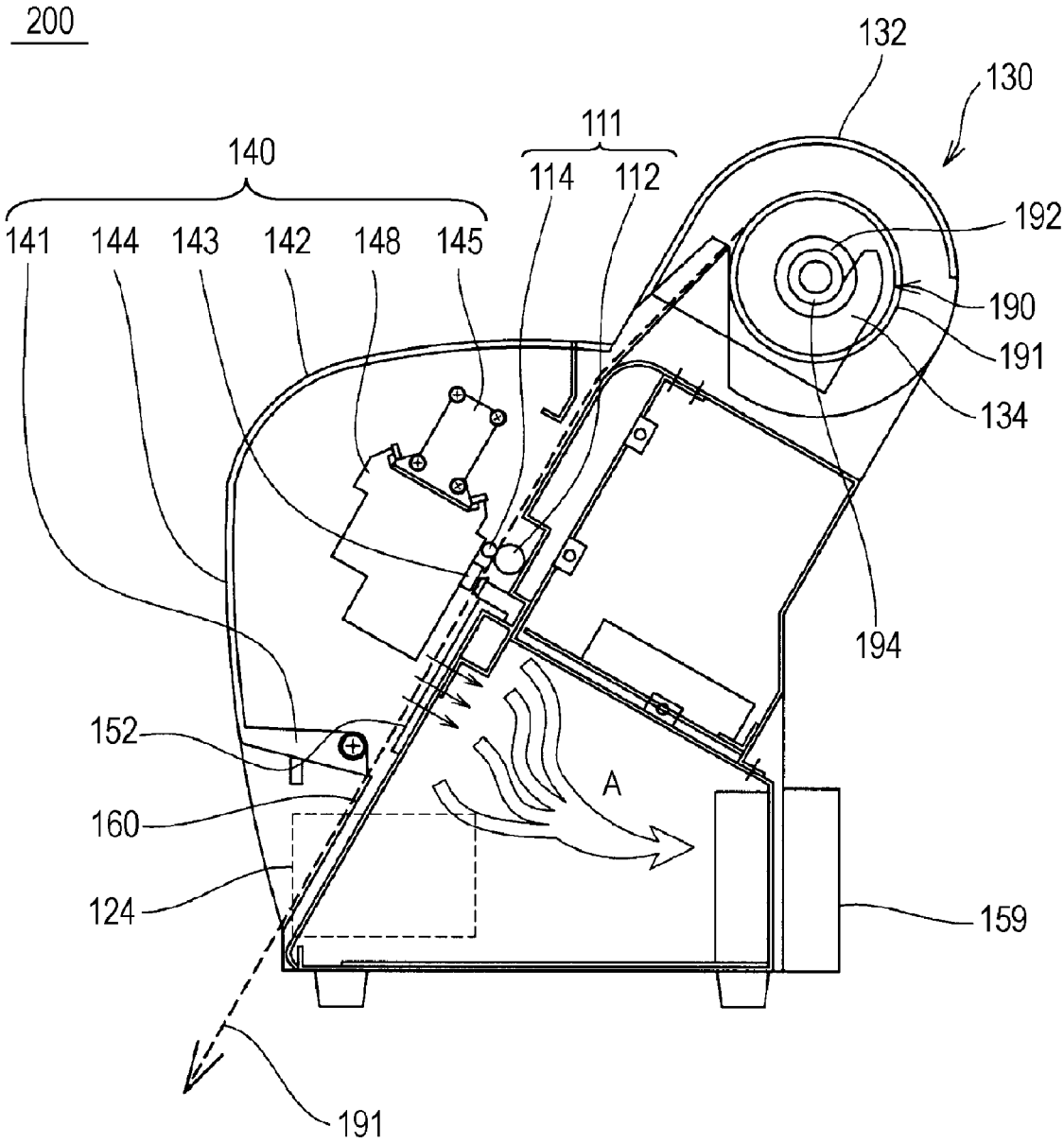
FIG. 4 is a cross sectional view schematically showing a feed pathway of a recording medium.

FIG. 4 is a cross sectional view schematically showing a feed pathway of the recording medium 191 in the inner mechanism 200 of the ink jet type recording device 100. As shown in FIG. 4, a feed path way is formed in the recording unit 140 from the roll assembly 190 in the loading part 130 to the discharge part 160 via in the recording unit 140.

A feed unit 111 for feeding the recording medium 191, the recording head 143 for ejecting ink on the recording medium 191, a carriage 148 that mounts the recording head 143, a platen plate 152 for supporting the recording medium 191, and the like are disposed in the recording unit 140. The feed unit 111 includes a feed drive roller 112 rotatably driven by a feed motor not shown and a feed driven roller 114 that makes contact with the feed drive roller 112 to be rotated therewith. The recording medium 191 is sandwiched between the feed drive roller 112 and the feed driven roller 114 and is pushed to the feed drive roller 112 by the feed driven roller 114. Herewith, the recording paper 191 is pulled out from the roll assembly 190 in accordance with the rotation of the feed drive roller 112.

The recording medium 191 pulled out from the roll assembly 190 and passed through the feed unit 111 passes through the position opposing the recording head 143. At the time, the recording medium 191 is supported by the platen plate 152 at the side opposing the recording head 143. Herewith, the recording medium 191 on the platen plate 152 is positioned with a constant distance with respect to the recording head 143.

Further, a fan unit not shown is disposed behind the platen plate 152 (right side in FIG. 4), that is, at the side opposite to the surface supporting the recording medium. As shown by the arrow A in FIG. 4, the fan unit discharges the air absorbed from the platen plate 152 to the outside from a discharge duct 159. Herewith a negative pressure is formed on the surface of the platen plate 152, and the recording medium 191 is absorbed to the platen plate 152. Accordingly, the recording medium 191 curled in the roll assembly becomes flat on the platen plate 152.

The recording head 143 is mounted in the carriage 148, and the carriage 148 is suspended from a guide rail 145. The guide rail 145 is extended along approximately the whole width of the recording unit 140 in the direction perpendicular to the paper surface of FIG. 3. The guide rail 145 guides the carriage 148 so as to be reciprocated. Note that the ink ejected from the recording head 143 is supplied from the ink cartridge 124 via a pipe not shown. Accordingly, the ink cartridge 124 is not mounted in the carriage 148. This allows reducing the weight of the assembly of the carriage 148 and the recording head 143 that are reciprocated.

In the aforementioned inner mechanism 200, the recording medium 191 is pulled out from the roll assembly 190 by the feed unit 111 and the recording medium 191 becomes flat and is positioned on the platen plate 152. Ink is ejected from the recording head 143 on the recording medium 191 and an image is formed. Further, the recording medium 191 is passed through the platen plate 152 and is discharged to the outside form the discharge part 160.

Figure 5:
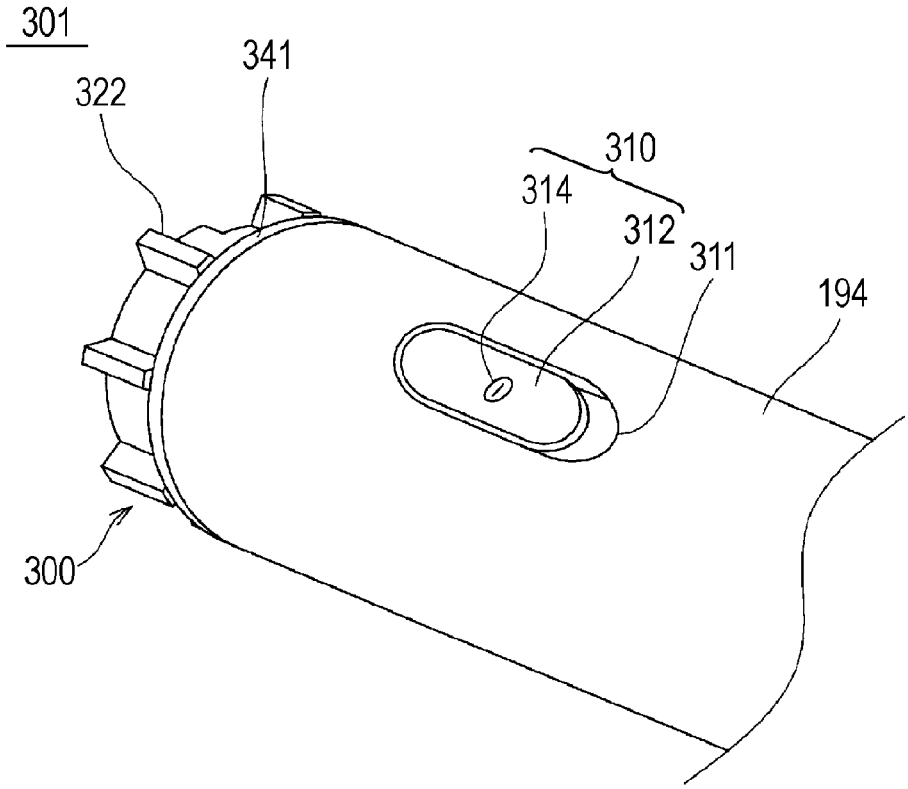
FIG. 5 is a perspective view showing near a resistance generating unit in a spindle assembly.

FIG. 5 is an enlarged diagram showing the vicinity of the resistance generating unit 300 attached at an end of the spindle member 194 in the spindle assembly 301. As shown in FIG. 5, the fitting part 322 is extended from the end of the spindle member 194 in the longitudinal direction of the spindle member 194.

A flange part 341 of a rotary sleeve 340 (see FIG. 7) described below can be viewed at the end of the spindle member 194. Further, a window part 311 is formed near the end of the spindle member 194. A switch knob 310 that is fixed to a clutch ring 370 (see FIG. 8) described below with a screw 314 is exposed inside the window part 311. Note that the switch knob 14 also forms a part of the resistance generating unit 300 as described below.

Herein, each of the fitting part 322, switch knob 310, and a flange part 341 is disposed inside the periphery surface of the spindle member 194 and the extended surface thereof. Herewith, the spindle member 194 can be smoothly inserted into or pulled out from the paper pipe 192. Note that other parts of the resistance generating unit 300 are disposed inside the spindle member 194.

Figure 6:
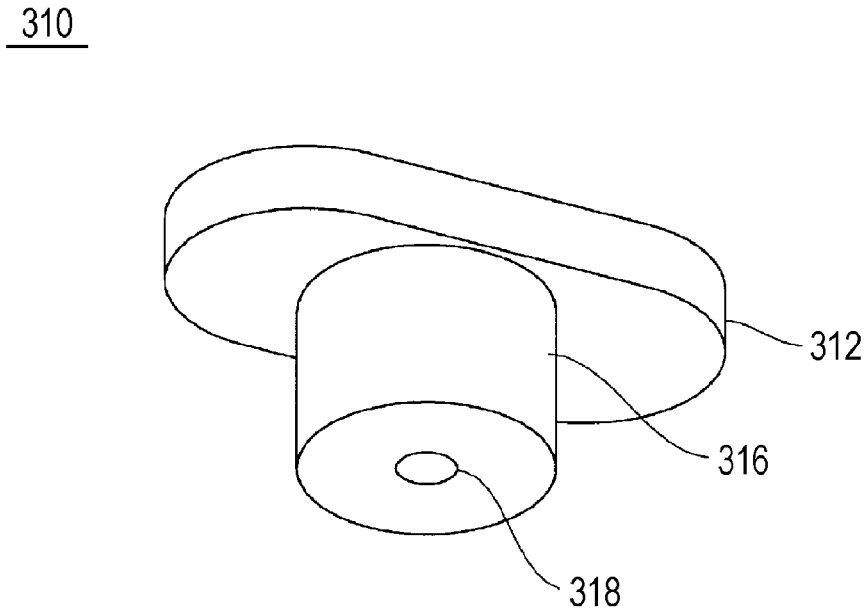
FIG. 6 is a perspective view separately showing a switch knob.

FIG. 6 is a perspective view separately showing the switch knob 310 from which the screw 314 is detached. As shown in FIG. 6, a leg part 316 having a cylindrical shape is extended toward the lower direction from an operation part 312 of the switch knob 310. Further, a through hole into which the screw 314 is inserted is formed at the center of the leg part 316.

Figure 7:
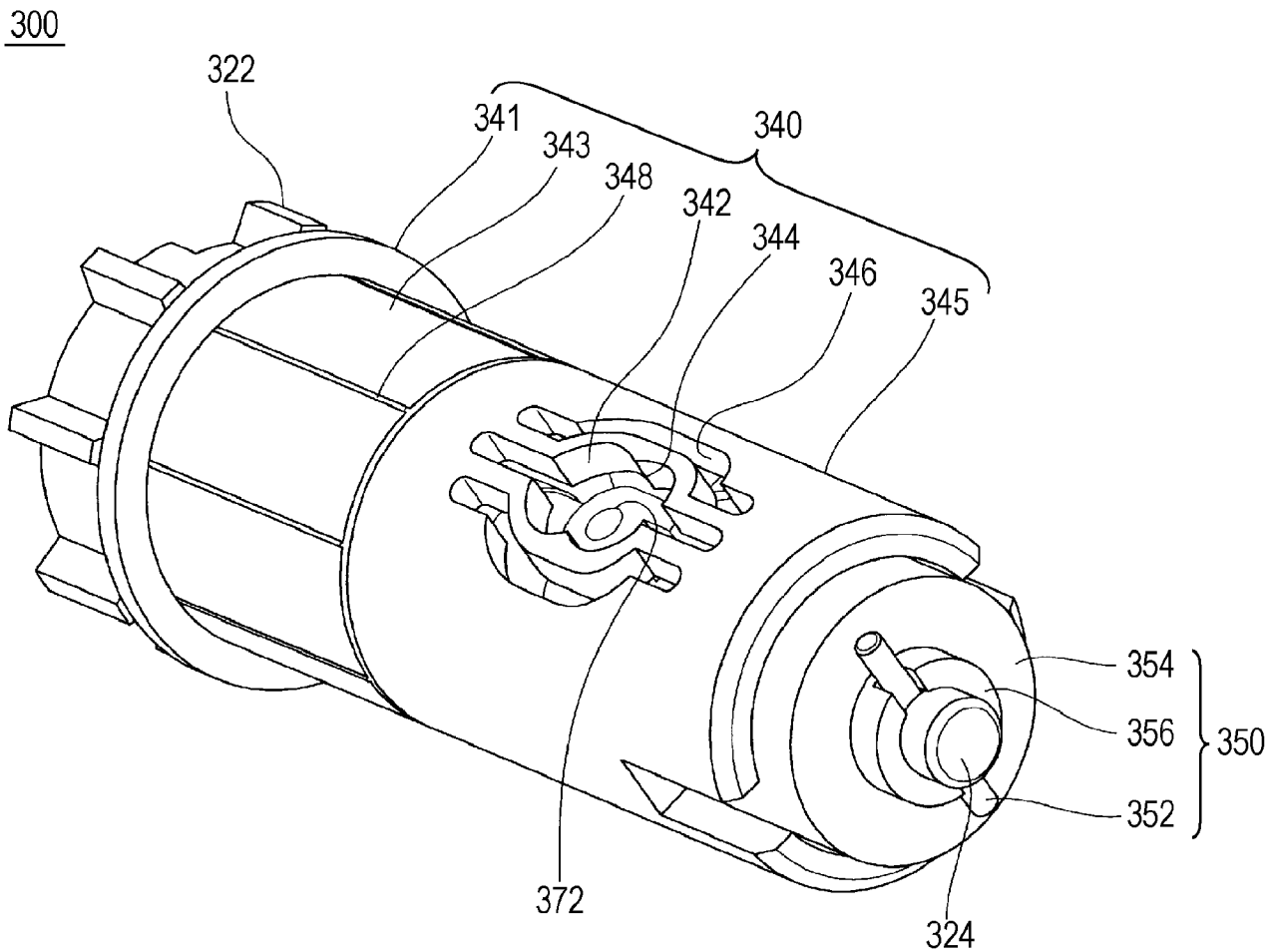
FIG. 7 is a perspective view showing an appearance of the resistance generating unit.

FIG. 7 is a perspective view showing an appearance of the resistance generating unit 300 which is exposed by taking out the spindle member 194 from the spindle assembly 301 after the switch knob 310 is detached. As shown in FIG. 7, if the spindle member 194 is unfixed, the rotary sleeve 340 that is fitted inside the spindle member 194 appears.

The rotary sleeve 340 integrally includes a crimping part 343 having an outer diameter approximately equal to an inner diameter of the spindle member 194 and a guide sleeve 345 having a diameter slightly smaller than the crimping part 343 in addition to the flange part 341 exposed from the end of the spindle member 194. The crimping part 343 has a plurality of protruded ribs 348 on the surface. When the rotary sleeve 340 is compressed inside the spindle member 194, the ribs 348 are strongly made contact with the inner surface of the spindle member 194. Herewith, the rotary sleeve 340 compressed in the spindle member 194 is rotated with the spindle member 194.

Note that as is not shown in FIG. 7, the crimping part 343 of the rotary sleeve 340 has a small inner diameter also in the inner part. Accordingly, the rotary sleeve 340 is also strongly made contact with an outer ring 364 (see FIG. 8) of a torque limiter 360 described below and is rotated therewith.

The guide sleeve 345 is easily intruded in the spindle member 194, so that the guide sleeve 345 guides the distal end of the rotary sleeve 340 when the rotary sleeve 340 is inserted into the spindle member 194 and stabilizes the rotary sleeve 340 when the crimping part 343 is compressed. Further, a guide part 342 including a latch 344 and a pair of opened parts 346 formed to sandwich the guide part 341 are formed so as to be passed through to the inner surface of the guide sleeve 345 at the middle of the guide sleeve 345.

The leg part 316 of the aforementioned switch knob 310 is inserted into the guide part 342. Further, since the opened parts 346 are formed, the side walls of the guide unit 342 can be slightly extended in the circumferential direction of the rotary sleeve 340 by elastic deformation. Herewith, the leg part 346 can be moved beyond the latch 344 in the guide unit 243.

Further, when the leg part 316 inserted into the guide unit 342, a lower end of the leg part 316 is made contact with the clutch ring 370 (see FIG. 8) that can be viewed inside the guide unit 342. Further, by threading a distal end of the screw 314 that is inserted into the through hole 318 of the switch knob 310 into a screw hole 372, the switch knob 310 is combined with the clutch ring 370.

Herewith, when the switch knob 310 is operated to move the leg part 316, the clutch ring 370 is also moved therewith. Further, in the state where the spindle member 194 is attached to the rotary sleeve 340, the outer ring 364, the rotary sleeve 340, the switch knob 310, and the clutch ring 370 are rotated with the spindle member 194.

Note that the flange portion 341 determines the position at which the spindle member 194 is stopped without making contact with the fitting part 322 when the rotary sleeve 340 is compressed in the spindle member 194. Further, an outer ring 354 of a torque limiter 350 can be viewed at an inner side of the end opposite to the flange part 341 of the rotary sleeve 340. The outer ring 354 will be described below with reference to FIG. 8.

Figure 8:
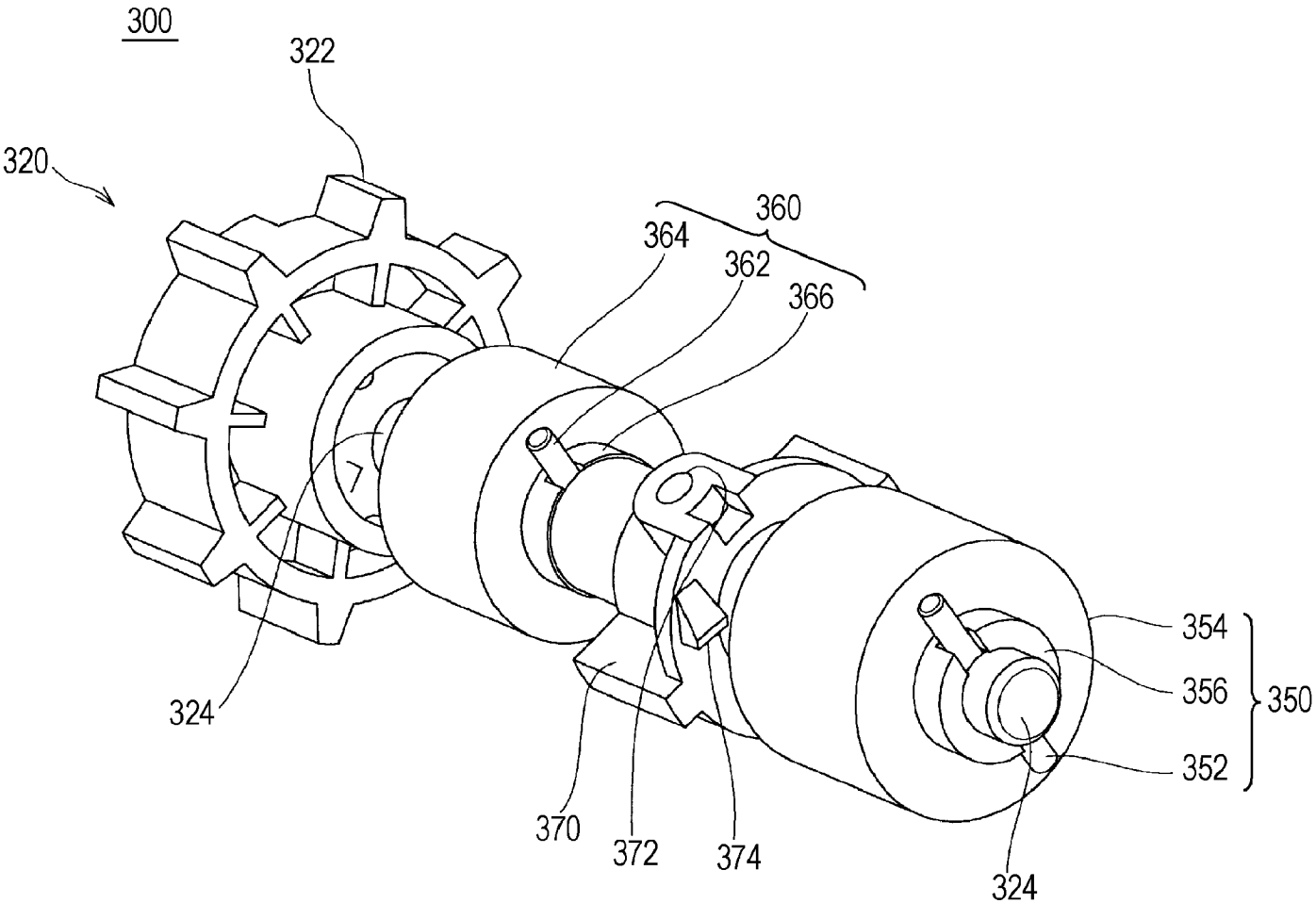
FIG. 8 is a perspective view showing the resistor generating unit from which a rotary sleeve is detached.

FIG. 8 is a perspective view showing the sate where the rotary sleeve 340 is detached from the resistance generating unit 300. As shown in FIG. 8, the resistance generating unit 300 is equipped with a pair of torque limiters 350, 360 and the clutch ring 370 disposed therebetween inside the rotary sleeve 340.

The clutch ring 370 can be moved in the longitudinal direction of the spindle assembly 301 between the torque limiters 350, 360. Further, the clutch ring 370 is attached to a shank 324 (see FIG. 10) combined with the fitting part 322 in a rotatable manner. Further, the clutch ring 370 has a latch 374 at the side surface opposing the torque limiter 350. The latch 374 is engaged with a fitting hole (not shown) formed at a side surface of the torque limiter 350 when the clutch ring 370 is come close to the torque limiter 350. Herewith, the latch 374 is engaged with the torque limiter so that the outer ring 354 of the torque limiter rotates with the clutch ring 370.

Note that a surface of the latch 374 in the circumferential direction makes an appropriately right angle to the side surface of the clutch ring 370, and the other surface of the latch 374 in the circumferential direction makes a moderate slope to the side surface of the clutch ring 370.

Accordingly, when the clutch ring 370 is rotated in the direction so that the surface of the latch 374 that makes a right angle is made contact with the torque limiter 350, the rotation is transmitted to the torque limiter 350 from the clutch ring 370. On the other hand, when the clutch ring 370 is rotated in the reverse direction, the rotation is not transmitted to the torque limiter 350.

With the structure, for example, when the recording medium 191 is pulled out from the roll assembly 190, the idling torque of the torque limiter is operated to the recording medium 191 as a tensile force. On the other hand, when the roll assembly 190 is reversely rotated in order to, for example, eliminate slackness of the recording medium 191, a rotational resistance generated by the torque limiter 350 can be negated to smoothly rotate the roll assembly 190.

Figure 9:
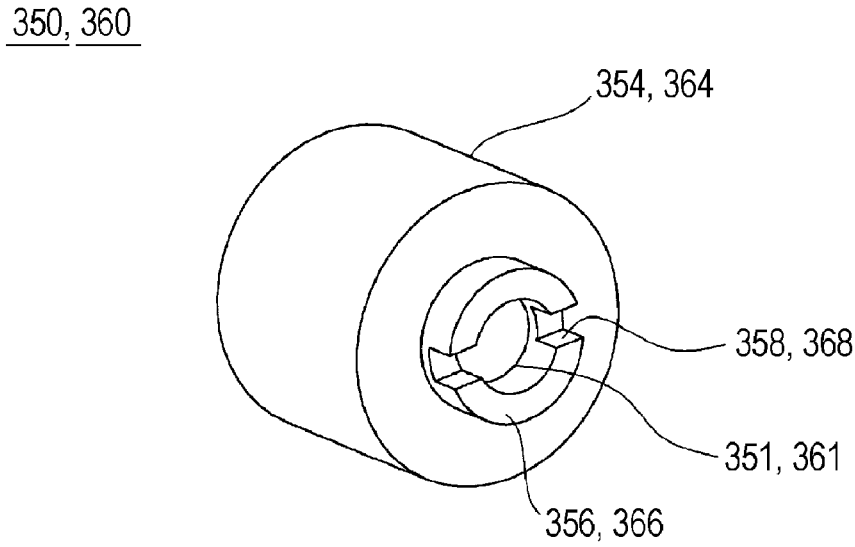
FIG. 9 is a diagram separately showing a torque limiter.

FIG. 9 is a diagram separately showing the torque limiter 350 (360). As shown in FIG. 9, each of the torque limiters 350 (360) has an inner ring 356 (366) and an outer ring 354 (364) having the same axis to each other. The inner ring 356 (366) can be rotated with respect to the outer ring 354 (364). However, there is a frictional resistance therebetween.

Accordingly, when one of the inner ring 356 (366) and the outer ring 354 (364) is rotated, the other one is also rotated in accordance with the rotation. However, when a load not less than a predetermined amount is applied, one of the rings stops rotating due to slipping to each other. In this regard, there is a frictional resistance between the inner ring 356 (366) and the outer ring 354 (364), so that a rotational resistance generates therebetween.

Further the inner ring 356 (366) is longer than the outer ring 354 (364) in the axis direction and has an engagement part 358 (368) that protrudes to a side direction from the outer ring 354 (364). The engagement part 358 (368) is engaged with a pin 352 (362) that is inserted into through holes 325, 326 formed in the shank 324 of a fitting member 320 described below, the inner ring 356 (366) is integrally rotated with the fitting member 320.

Figure 10:
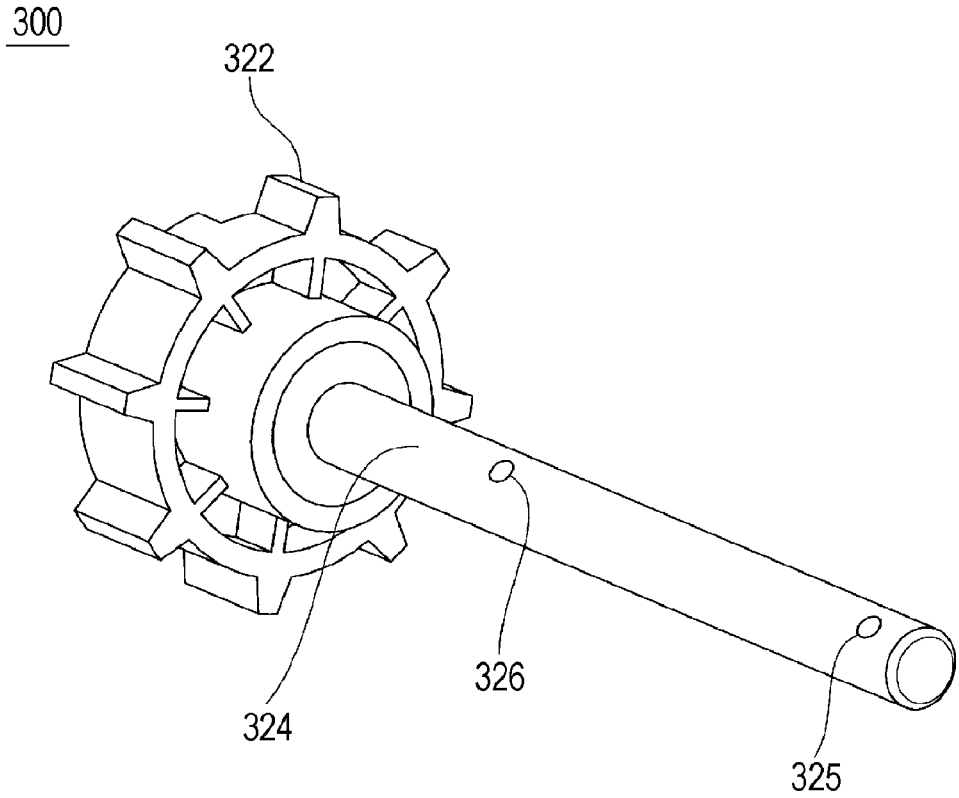
FIG. 10 is a diagram separately showing a fitting member.

FIG. 10 is a diagram separately showing the fitting member 320 to which the torque limiter 350 (360) is attached. As shown in FIG. 10, the fitting member 320 is equipped with the fitting part 322 that is exposed at an end of the spindle assembly 301 and the shank 324 fixed to the fitting part 322 so as to have the same axis. The through hoes 325, 326 through which the pins 352, 362 described below are inserted are formed in the shank 324.

See FIG. 8 again. In the case where the clutch ring 370 is moved near the torque limiter 360, the clutch ring 370 and the torque limiter 350 are separated to each other. Consequently, when the spindle member 194 is rotated in the spindle assembly 301, the rotation is transmitted to the outer ring 364 of the torque limiter 360 via the rotary sleeve 340. On the other hand, the inner ring 366 of the torque limiter 360 is fixed to the fitting part 322 via the shank 324. Accordingly, a rotational resistance caused by an idling torque of the torque limiter 360 is generated between the fitting part 322 and the spindle member 194.

Herein, when the clutch ring 370 is moved to the side of the torque limiter 350 by operating the switch knob 310, the clutch ring 370 and the torque limiter 350 are combined to each other via the latch 374. Consequently, when the spindle member 194 is rotated in the spindle assembly 301, the rotation is transmitted to the outer ring 354 of the torque limiter 350 via the rotary sleeve 340, the switch knob 310, and the clutch ring 370.

Since the inner ring 356 of the torque limiter 350 is engaged with the fitting part 322 via the shank 324, an idling torque is generates in the torque limiter 350. Since the torque limiter 360 is always combined with the rotary sleeve 340, a rotational resistance in which the idling torque of the torque limiter 350 and the idling torque of the torque limiter 360 are added is generated between the fitting part 322 and the spindle member 194.

The rotational resistance with respect to the rotation of the spindle member 194 is operated as a tensile force to the recording medium 191 when the recording medium 191 is pulled out from the roll assembly 190 as shown in FIG. 4. Herewith, flatness of the recording medium 191 is maintained and idling of the roll assembly 190 is prevented when pulling out of the recording medium 191 is stopped. Further, as described above, the resistance generating unit 300 can generates two-step rotational resistances in accordance with the operation of the switch knob 310. Accordingly, for example, when an image is recorded on the recording medium 191 that is highly influenced by habitual curling as is thick and having high bending rigidity, a large rotational resistance is generated to increase the tensile force. Further, when an image is recorded on the recording medium 191 that is thin and having low bending rigidity, the rotational resistance is lowered to reduce the tensile force.

Note that in the aforementioned embodiment, only the torque limiter 360 is always activated and the torque limiter 350 is activated or inactivated by the operation of the switch knob 310. However, the plurality of torque limiters 350, 360 may be selectively activated.

The embodiment of the invention is described above. However, the technical scope of the invention is not limited to the scope described in the aforementioned embodiment. It is apparent for a person skilled in the art that various modifications and alternations can be made to the aforementioned embodiment. It is apparent from the description of Claims that the embodiment in which such modifications and alternations are made can be also included in the technical scope of the invention.

What is claimed is:

1. A resistance generating device comprising:

a rotation axis that rotates with a roll formed by winding a long recording medium;

a fixed part disposed outside the rotation axis in a longitudinal direction of the rotation axis, the fixed part allowing rotation of the rotation axis while being fixed to an outside;

a switch part disposed inside a surface of the rotation axis; and a resistance generating unit disposed inside the rotation axis, the resistance generating unit having an inner ring and an outer ring, one of the inner ring and the outer ring being combined with the fixed part, the one being rotated with respect to the other one of the inner ring and the outer ring while generating a rotational resistance;

wherein, the switch part is configured to switch the resistance generating unit between a combined state and a non-combined state in accordance with an operation from outside, wherein the resistance generating unit is operative to generate the rotational resistance in the combined state and the resistance generating unit is unlocked in the non-combined state.

2. The resistance generating device as claimed in claim 1, wherein a rotational resistance generated in the resistance generating unit is operated as a tensile force with respect to the recording medium when the recording medium is pulled out from the roll.

3. The resistance generating device as claimed in claim 1, wherein the resistance generating unit generates a rotational resistance in a rotational direction of the one with respect to the other one and does not generate a rotational resistance in an opposite rotational direction.

4. The resistance generating device as claimed in claim 1 further comprising: a sub resistance generating unit for steadily generating a rotational resistance with respect to a rotation of the rotation axis with respect to the fixed part regardless of a state of the switch part.

5. The resistance generating device as claimed in claim 1, wherein the switch part selectively combines a plurality of resistance generating parts each of which generates a rotational resistance having a different magnitude to each other.

6. The resistance generating device as claimed in claim 1, wherein the switch part switches the resistance generating unit between the combined state and the non-combined state by moving in the longitudinal direction of the rotation axis according to the operation from the outside.

7. A recording apparatus comprising:

a rotation axis that rotates with a roll formed by winding a long recording medium;

a fixed part disposed outside the rotation axis in a longitudinal direction of the rotation axis, the fixed part being fixed to an outside and being rotated with respect to the rotation axis;

a resistance generating unit disposed inside the rotation axis, the resistance generating unit having an inner ring and an outer ring, one of the inner ring and the outer ring being combined with the rotation axis, the one being rotated with respect to the other one of the inner ring and the outer ring while generating a rotational resistance;

a switch part disposed inside a surface of the rotation axis, the switch part configured to switch the resistance generating unit between a combined state and a non-combined state in accordance with an operation from outside, wherein the resistance generating unit is operative to generate the rotational resistance in the combined state and the resistance generating unit is unlocked in the non-combined state; and a recording head for ejecting ink toward the recording medium pulled out from the roll.

8. The recording apparatus as claimed in claim 7, wherein the switch part switches the resistance generating unit between the combined state and the non-combined state by moving in the longitudinal direction of the rotation axis according to the operation from the outside.

* * * * *